US007004002B2

(12) United States Patent
Nishi et al.

(10) Patent No.: US 7,004,002 B2
(45) **Date of Patent: *Feb. 28, 2006**

(54) ROLLING METHOD FOR STRIP ROLLING MILL AND STRIP ROLLING EQUIPMENT

(75) Inventors: Hidetoshi Nishi, Hitachi (JP); Hirokazu Nakamae, Hitachi (JP); Kenichi Yasuda, Hitachinaka (JP); Kenji Horii, Hitachi (JP); Youichi Matsui, Hitachinaka (JP); Ichirou Maeno, Hitachinaka (JP); Hideo Kobayashi, Hitachi (JP); Haruyuki Yabe, Kitaibaraki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/848,134

(22) Filed: May 19, 2004

(65) Prior Publication Data

US 2004/0206147 A1 Oct. 21, 2004

Related U.S. Application Data

(63) Continuation of application No. 09/942,039, filed on Aug. 30, 2001, now Pat. No. 6,868,707.

(30) Foreign Application Priority Data

Feb. 5, 2001 (JP) ..... 2001-027625

(51) Int. Cl.
*B21B 1/32* (2006.01)

(52) U.S. Cl. ..... 72/229; 72/247

(58) Field of Classification Search ..... 72/9.2, 72/9.3, 11.2, 11.3, 11.7, 11.9, 229, 241.4, 72/247, 252.5

See application file for complete search history.

(56) References Cited

U.S. PATENT DOCUMENTS

| | | | | |
|---|---|---|---|---|
| 3,857,268 | A * | 12/1974 | Kajiwaka | 72/247 |
| 3,902,345 | A * | 9/1975 | Shida | 72/8.9 |
| 4,369,646 | A * | 1/1983 | Kajiwara | 72/241.8 |
| 5,622,073 | A * | 4/1997 | Hiruta et al. | 72/247 |
| 6,286,354 | B1 * | 9/2001 | Kajiwara et al. | 72/327 |

FOREIGN PATENT DOCUMENTS

| | | |
|---|---|---|
| DE | 19811633 | 9/1999 |
| JP | 5045761 | 4/1975 |

(Continued)

OTHER PUBLICATIONS

Akinori Hiraiwa, et al., "Development of Strip Profile Control System in Tandem Cold Rolling at Sakai Works" Nisshin Steel Technical Report, No. 79, pp. 47-48, 1999.

(Continued)

*Primary Examiner*—Lowell A. Larson
(74) *Attorney, Agent, or Firm*—Crowell & Moring LLP

(57) ABSTRACT

A strip rolling mill includes a pair of upper and lower work rolls for rolling a strip, intermediate rolls for supporting each of the paired work rolls, and back-up rolls for supporting each of the intermediate rolls. Each of the work rolls is provided with a tapered portion at one end thereof so that the tapered portions of the work rolls are on opposite sides of roll bodies thereof with respect to roll axis directions. When the material with a constant width is being rolled, axial positions of the work rolls are set at appropriate positions and axial positions of the intermediate rolls are changed to control a thickness distribution in a width direction of the material being rolled. This arrangement significantly improves an edge drop and at the same time minimizes edge drop variations.

2 Claims, 8 Drawing Sheets

FOREIGN PATENT DOCUMENTS

| | | | |
|---|---|---|---|
| JP | 55077903 | | 6/1980 |
| JP | 5918127 | | 4/1984 |
| JP | 60-102206 | * | 6/1985 |
| JP | 60-216910 | | 10/1985 |
| JP | 61126903 | | 6/1986 |
| JP | 62151203 | | 7/1987 |
| JP | 08192213 | | 7/1996 |
| JP | 10076301 | | 3/1998 |
| JP | 11123407 | | 5/1999 |
| TW | 396065 | | 7/2000 |
| TW | 396066 | | 7/2000 |
| TW | 396067 | | 7/2000 |
| TW | 407069 | | 10/2000 |
| WO | WO 01/05527 | | 1/2001 |
| WO | WO 01/05528 | | 1/2001 |

OTHER PUBLICATIONS

Copy of Office Action generated in corresponding Taiwanese application No. 90121038 and English translation of Office Action.

European Search Report dated Jun. 16, 2005.

* cited by examiner

EDGE DROP AMOUNT ε (μm)
WORK ROLL POSITION δw (mm)
INTERMEDIATE ROLL POSITION δi (mm)
E0
E1
δw0
0
10
20
30
50
100
ROLLING TIME
1 COIL ROLLING TIME

ROLLING METHOD FOR STRIP ROLLING MILL AND STRIP ROLLING EQUIPMENT

BACKGROUND OF THE INVENTION

The present invention relates to a rolling method for a strip rolling mill and to a strip rolling facility or equipment.

When a strip is rolled, the strip thickness is distributed non-uniformly in a strip width direction. In a conventional four-high rolling mill in particular, there occur a so-called edge drop in which the thickness decreases sharply at the width ends of the strip, resulting in degrading a quality of and lowering yields of a rolled product.

In view of this problem, there has been a demand for a technology for changing a strip thickness distribution over the entire width and for reducing the edge drop. Examples of such a technology concerning a six-high rolling mill are disclosed in JP-59-18127B, JP-50-45761A, and Nisshin Seiko Technical Report No. 79 (1999), pp 47–48.

Other examples include JP-60-51921B, JP-08-192213A, JP-61-126903A, JP-03-51481A, JP-11-123407A and JP-10-76301A.

During the process of rolling a strip, the amount of edge drop varies even when the strip width is constant. The reason for this is that a profile of the material, its hardness distribution, a rolling load and an amount of roll heat expansion vary during rolling and thus change the amount of edge drop. The present applicants have found that moving a work roll in the axial direction during rolling to minimize these changes results in grave defects in the surface of the material being rolled.

This surface defect problem is particularly more serious with a reversible rolling mill which uses one or a small number of stands and performs multiple rolling passes by reversing the rolling direction than with a tandem mill that uses a plurality of rolling mills and performs a rolling operation in only one direction.

BRIEF SUMMARY OF THE INVENTION

An object of the present invention is to improve the edge drop significantly and to perform a rolling operation efficiently without causing surface defects in a strip while at the same time minimizing edge drop variations.

According to one aspect, the present invention provides a rolling method for a strip rolling mill, the strip rolling mill including a pair of upper and lower work rolls for rolling a strip, intermediate rolls for supporting each of the paired work rolls, and back-up rolls for supporting each of the intermediate rolls, wherein each of the work rolls is provided with a tapered portion near one end thereof, and the tapered portions of the work rolls are arranged on opposite sides of the respective roll bodies with respect to roll axis directions, the rolling method comprising the steps of: when the material with a constant width is being rolled, setting axial positions of the work rolls at desired positions and changing axial positions of the intermediate rolls to control a thickness distribution in a width direction of the material being rolled.

DETAILED DESCRIPTION OF THE INVENTION

Figure 1:
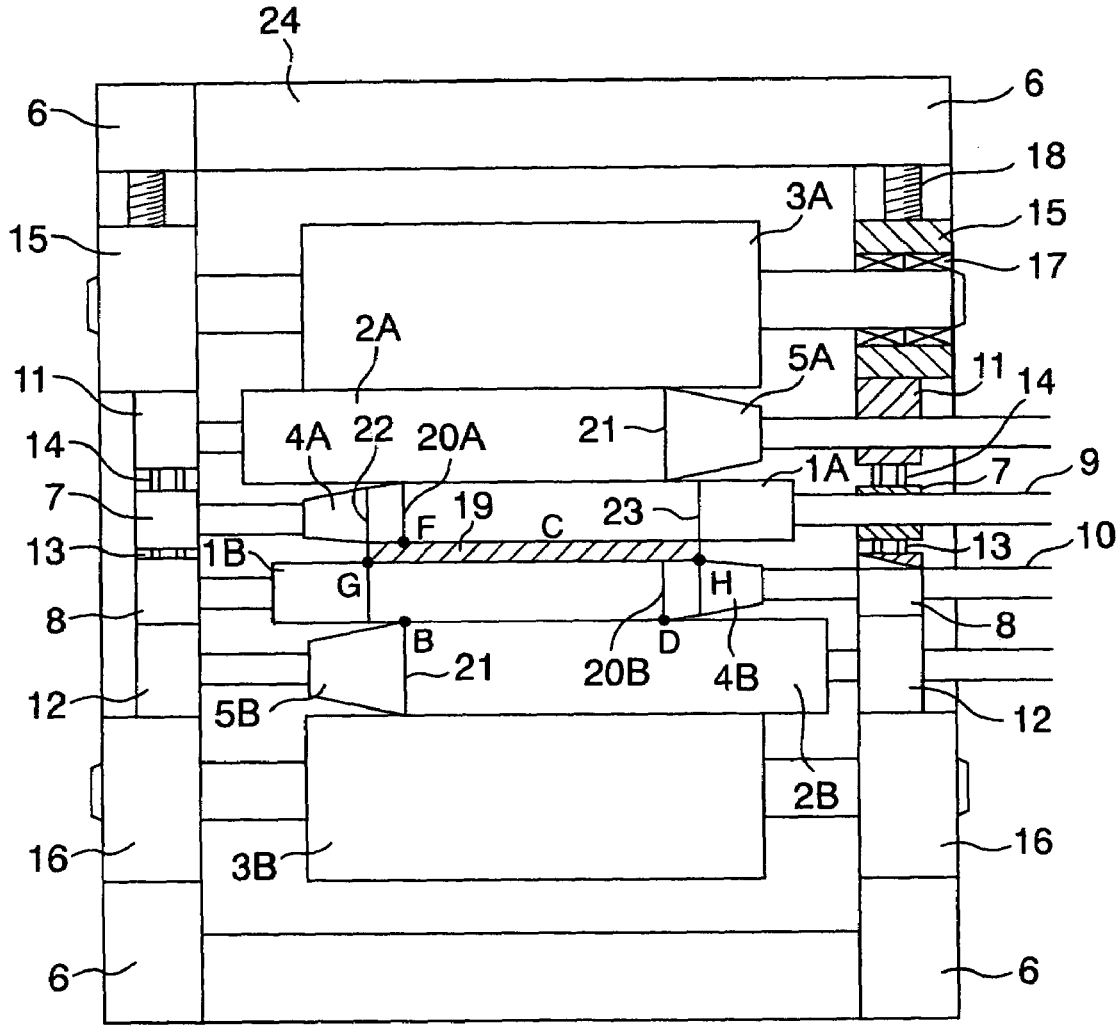
FIG. 1 is a side view of a six-high rolling mill in which the present invention has been incorporated.

Before proceeding to a detailed description on the embodiments of the invention, a brief explanation of a variety of techniques will be given.

A technique A1 uses, in a six-high rolling mill, work rolls of a relatively small diameter and axially movable intermediate rolls with one ends of their roll bodies tapered and can change a strip thickness distribution in the width direction and also reduce the edge drop by moving the tapered ends of the intermediate rolls close to the widthwise ends of a strip. For example, a strip crown (strip thickness distribution in the width direction) can be changed by adjusting the amount of axial displacement of the intermediate rolls. Further, the edge drop can also be reduced by adjusting the amount of axial movement of the intermediate rolls. In a four-stand tandem mill, this technique can control a WRB (work roll bender force), IMRB (intermediate roll bender force), IMRδ (intermediate roll displacement position) to achieve a significant improvement on a strip thickness deviation (edge drop) from a target thickness at a position 100 mm from the edge.

A technique A2 has axially movable work rolls with tapered portions and moves start points of the tapered portions toward the interior of the strip width. This technique can reduce the edge drop more directly by a geometrical effect. Examples of rolling mills that can employ this technique include the following techniques A2-1 and A2-2.

A technique A2-1 allows work rolls to be moved axially in a four-high rolling mill.

By changing an EL (distance between the start point of the tapered portion of each work roll and a strip width edge), the thickness at the edge of the strip (edge drop) can be made to approach that of the strip center. This method can also be combined with another method that moves the upper and lower work rolls crosswise in opposite directions in a horizontal plane while at the same time moving the work rolls in the axial directions, thereby minimizing edge drop variations.

A technique A2-2, in a six-high rolling mill, uses axially movable work rolls and axially movable intermediate rolls, both having tapered portions, and can achieve the effects of both the techniques A1 and A2-1 described above. These effects can be realized, for example, by positioning the taper start points of the work rolls and the intermediate rolls at locations near the strip edges or inside the strip width. These effects can also be realized by locating the taper start points (boundaries) of both the work rolls and the intermediate rolls at the same position and cyclically shifting the work rolls for prevention of partial wear.

A technique A2-3 in a six-high rolling mill, rather than providing the tapered portions on the work rolls and intermediate rolls of the technique A2-2, forms annular recesses in their end portions to lower a contact rigidity of these portions to make their compressive deformations easily occur, thus producing an effect virtually identical to that of the tapered portions of A2-2.

A technique A2-4, rather than providing the tapered portions on the intermediate rolls of the technique A2-2, forms an S-shaped roll crown on the intermediate rolls over their entire length and moves them axially to produce an effect virtually identical to that achieved by moving the intermediate rolls axially in the technique A2-2.

In addition to crossing the upper and lower work rolls of the four-high rolling mill as described above, a technique A2-5 offers a variety of methods for crossing upper and lower rolls, such as crossing intermediate rolls in a six-high rolling mill, crossing back-up rolls in a four- or six-high rolling mill, and crossing groups of upper and lower rolls in Sendzimir 12- and 20-high mills. These crossing methods are intended to produce effects similar to that achieved by moving the intermediate rolls axially in the technique A2-2.

Figure 2:
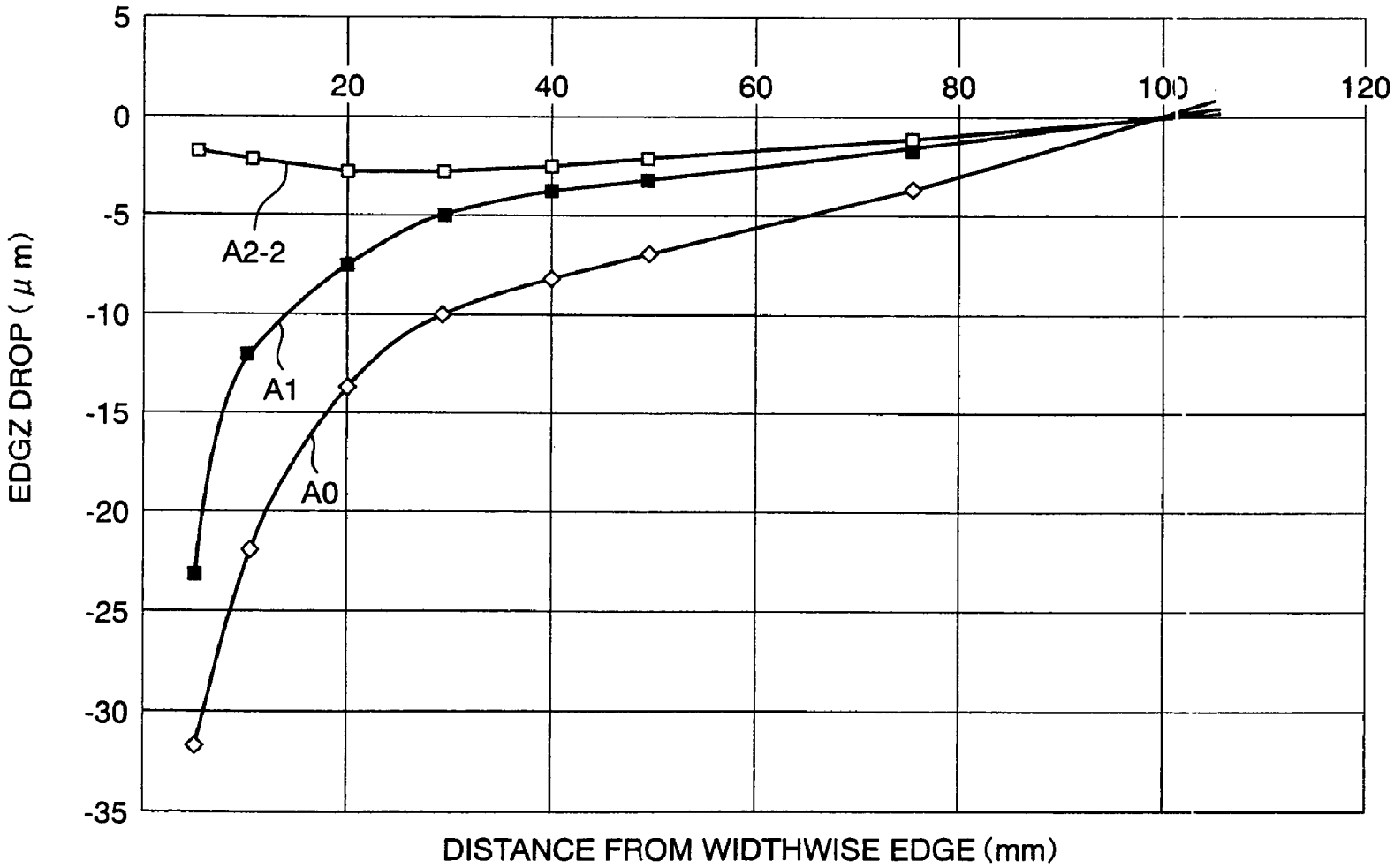
FIG. 2 is a graph showing how the edge drop decreases.

FIG. 2 shows a comparison in edge drop between a conventional four-high mill (technique A0) and the techniques A1 and technique A2-2 described above. The abscissa denotes a distance (mm) from a strip width edge, and the ordinate denotes an amount of edge drop ($\mu$m). In the conventional four-high mill (technique A0), the thickness deviates from the zero point overall and, near the strip width edge, a large edge drop is observed.

In contrast, with the technique A1, the edge drop is nearly halved, and the technique A2-2 reduces the edge drop further up to near the strip width edge.

The strip thickness distribution in the width direction, particularly the edge drop, can be reduced or changed by moving a variety of rolls in the axial direction, as described above, and by changing the roll bender force, roll cross angle, roll thermal crown, rolling load or draft. Of these methods, one that moves the work rolls with the tapered portions in the axial directions is considered most effective, followed by one that performs axial moving of the intermediate rolls with the tapered portion.

Next, variations in the amount of edge drop will be explained. During the rolling of a strip, the amount of edge drop changes even when the strip width is constant. The reason for this is that the profile of the material, hardness distribution, rolling load and roll thermal expansion vary during the rolling operation, which in turn changes the edge drop amount. To secure a good quality of a rolled product, not only does the edge drop need to be reduced but variations of the edge drop must also be minimized in manufacturing the rolled product with a uniform amount of edge drop. For this purpose, it is considered most effective to provide a tapered portion to each work roll and move them axially during the rolling. Further, JP-03-51481A describes that, to reduce partial wear of the rolls at the start points of the tapered portions, e.g., at points B and D in FIG. 1 of this reference, it is effective to move the work rolls oscillatingly during the rolling operation.

The present applicants, however, found that moving the work rolls in the axial directions during rolling as described in the above reference causes a serious defect in the surface of the material being rolled. The surface defects occur by the following two major causes.

The first surface defect is caused due to a strip edge mark. In the rolling of a strip, rolling mark 22, 23 called strip edge marks are formed on the surface of the work rolls by the width edge portions G, H of the material being rolled, in addition to the tapered portion start point D in FIG. 1. These marks, once formed on the surface of the work rolls, the mark at least on one side is shifted toward the inside of the strip width unless the strip width is changed by the axial movement of the work rolls, and transferred onto the surface of the strip. As a result, the surface defect is formed on the rolled product.

The second surface defect is due to a start point mark of the tapered portion. In JP-03-51481B, points B and D in FIG. 1 represent the start points of the tapered portions and, as explained in the detailed description, partial wear of the rolls cannot be avoided. Hence, although the cyclic shift can reduce or distribute the wear and improve the problem of the rolls themselves, the property (coarseness and gloss or brightness) of the roll surface differs between the vicinity of point D and other parts. Thus, when these points are moved into the inside of the strip width in order to improve the edge drop, it is not possible to secure a uniform property on the entire surface of the strip, with the result that the rolled material has a surface defect of spotted or ununiform distributions of coarseness and gloss or brightness.

With the techniques described above, when the work rolls with tapered portions are moved in order to minimize the variations in the amount of edge drop and keep it constant while the strip with a constant width is rolled, the surface defect problem arises, making it difficult to secure a desired quality of the rolled product.

This surface defect problem is particularly more serious with a reversible rolling mill that uses one or a small number of stands and performs multiple rolling passes by reversing the rolling direction, than with a tandem mill that uses a plurality of rolling mills and performs the rolling operation in only one direction. This can be explained as follows. Because, with the tandem mill, the edge drop control is normally performed by utilizing the movement of the work rolls on the entrance stand, the work rolls on the subsequent stands that governs the quality of the surface do not need to be moved axially and there exists an operation condition for dealing with the surface defect problem. With the reversible rolling mill, on the other hand, because all rolling passes are performed by the same work rolls, if the work rolls are formed with marks during the first pass, the strip surface is inevitably marked by the moving of the work rolls not only during that first pass but also during the subsequent passes.

The tandem mill, too, has the same surface defect problem if the work roll movement in the axial direction is required in the subsequent stands.

While it is possible to replace the marked work rolls with intact work rolls, whatever the type of the facility, an additional time required for replacement will degrade the production efficiency of the facility.

Figure 8:
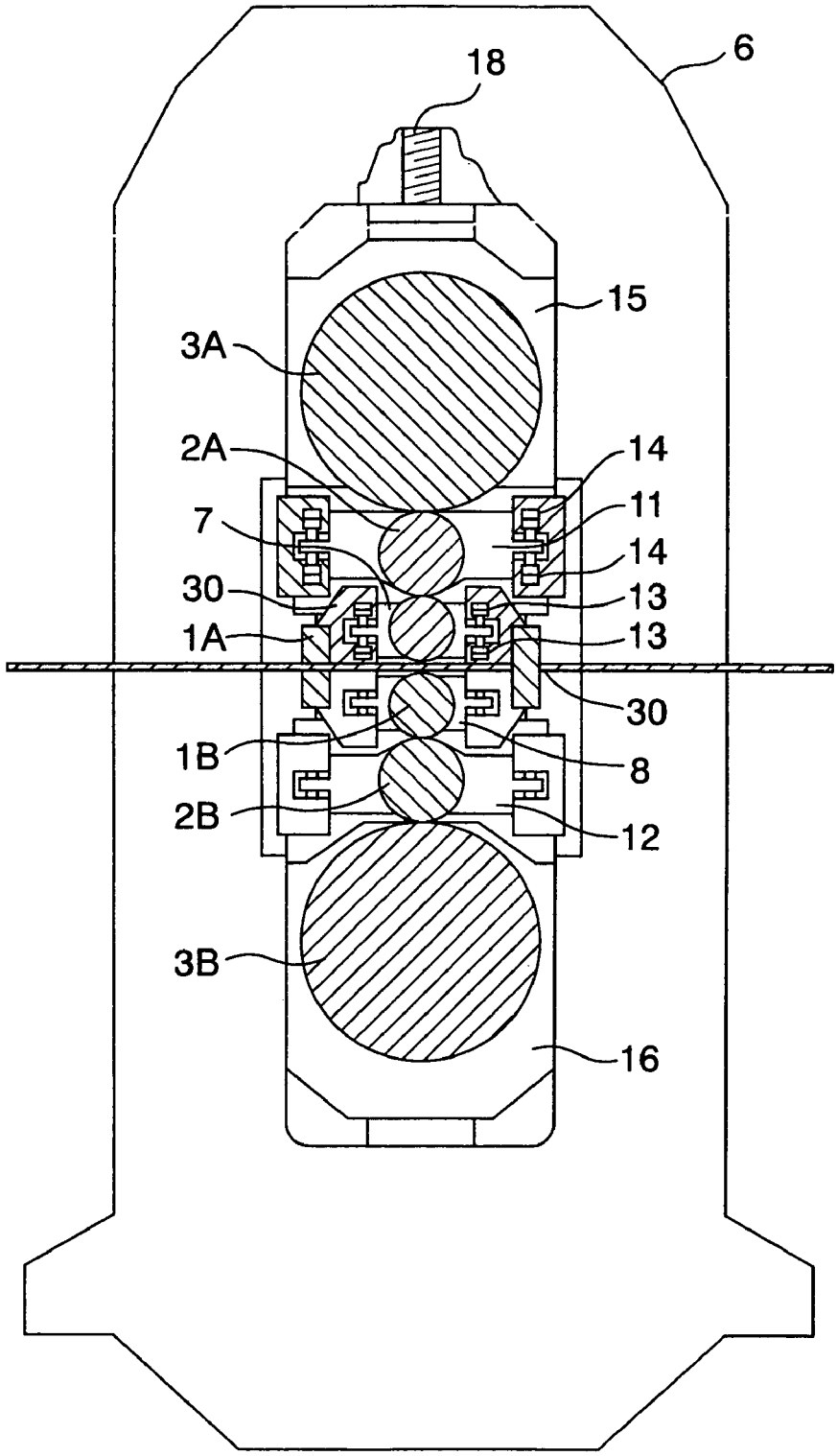
FIG. 8 is a vertical cross section of the six-high rolling mill in which the invention has been incorporated.

To solve this problem, the embodiment of this invention has, as shown in FIG. 1 and FIG. 8, a pair of upper and lower work rolls 1A, 1B for rolling a strip material, a pair of upper and lower intermediate rolls 2A, 2B for supporting each of the paired work rolls, and a pair of upper and lower back-up rolls 3A, 3B for supporting each of the paired intermediate rolls. This embodiment also has a drive mechanism for moving the work rolls 1A, 1B in the directions of roll axes and a drive mechanism for moving the intermediate rolls 2A, 2B in the directions of roll axes.

Figure 6:
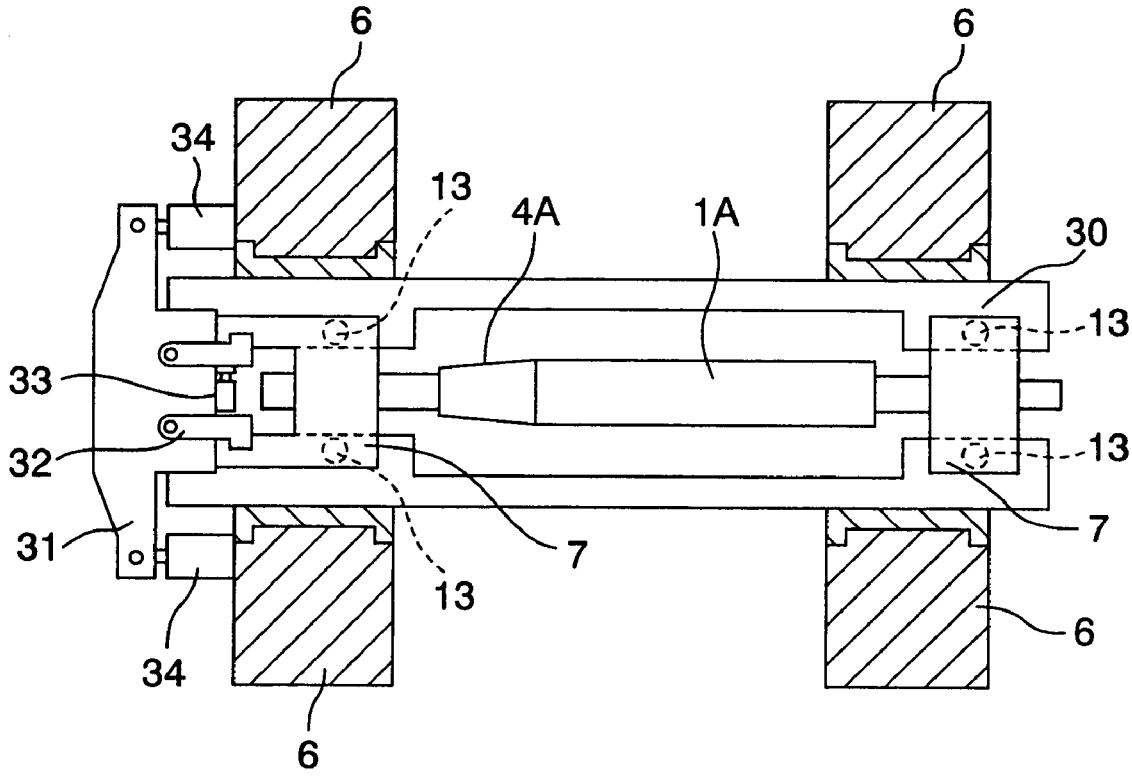
FIG. 6 is an upper view of a rolling mill showing a drive mechanism according to the invention for moving rolls in the roll axis directions.

The operation of these drive mechanisms will be explained by referring to FIG. 6 for an example of driving the work rolls. In FIG. 6, the drive mechanism has shift support members 30 for supporting work roll chocks 7 for the work roll 1A and a shift head 31 coupled to the shift support members 30. Mounted on the shift head 31 is a shift coupling/decoupling device which comprises hooks 32 and a connecting cylinder 33 both for universal coupling with the work roll chock 7 on one side. Further, the shift head 31 is connected to shift cylinders 34 secured to a mill housing 6. With the shift coupling/decoupling device coupled, the shift cylinders 34 are operated to move the work roll 1A and the shift support members 30 to discretionary positions. The shift support members 30 incorporate a work roll bender 13, so that even when the work roll 1A is shifted, the acting point of a bending force does not change, thus allowing the shift stroke to be set large. The drive mechanism for the intermediate rolls 2A, 2B has the similar construction and its illustration is omitted.

The work rolls 1A, 1B have tapered portions 4A, 4B at their one ends respectively. Similarly, the intermediate rolls 2A, 2B have tapered portions 5A, 5B. These work rolls 1A, 1B and intermediate rolls 2A, 2B are arranged in the mill housing 6 of the rolling mill 24 in such a manner that their tapered portions are alternated. That is, the pair of work rolls 1A, 1B each have a roll outline in which the roll body is formed at or vicinity to one end portion with a tapered portion whose roll diameter decreases toward the roll end. The work rolls 1A, 1B are arranged so that their tapered portions 4A, 4B are situated at opposite sides, with respect to the roll axis directions, of the roll bodies. The term "vicinity" to the roll end virtually refers to a range of each tapered portion 4A, 4B within which each of the strip widthwise ends of the material needs to be situated during the rolling operation. Therefore, that part of the roll end portion outside the strip width ends does not have to be tapered and this arrangement can still be expected to produce the similar effect.

The drive mechanism also has chocks 7, 8 for rotatably supporting the pair of upper and lower work rolls, rotary drive spindles 9, 10 for rotatably driving the pair of upper and lower work rolls 1A, 1B, and intermediate roll chocks 11, 12 for rotatably supporting the pair of upper and lower intermediate rolls 2A, 2B. It also has work roll benders 13 for controlling the deflections of the work rolls 1A, 1B, intermediate roll benders 14 for controlling the deflections of the intermediate rolls 2A, 2B, back-up roll chocks 15, 16 for rotatably supporting the back-up rolls 3A, 3B, back-up roll bearings 17, and screws-downs 18.

While a strip with a constant width is rolled, the work rolls 1A, 1B are set at appropriate positions and the intermediate rolls are moved in the axial direction to control the strip thickness distribution to become constant particularly near the width end portions of the material being rolled.

Further, as for the set positions of the work rolls 1A, 1B during the rolling operation, the start point of the tapered geometry is located within the strip width. That is, according to the width of the strip being rolled, the axial positions of the work rolls 1A, 1B are set at appropriate positions while the material with a constant strip width is rolled. This can prevent the above-described surface defect problem with the work roll. Particularly by setting the axial positions of the work rolls 1A, 1B so that the start point of the tapered geometry comes within the strip width while the strip with a constant width is rolled, the strip thickness distribution near the width end portion can be made uniform by the influence of the tapered portions.

Further, in at least the work rolls 1A, 1B that directly contact the material being rolled, it is desired that the start point of the tapered portion be formed in arc or round-shaped, rather than in an angled geometry, to prevent the partial wear of the start point of the tapered portion from making the property of the roll surface ununiform. Further, the desired axial positions of the work rolls 1A, 1B should preferably be fixed at arbitrary positions. It is also possible to provide a small allowable range of position to the extent that the actual rolling operation is not adversely affected.

In this embodiment, when rolling the material 19, the start points 20A, 20B of the tapered portions 4A, 4B of the work rolls are set at appropriate positions inside the width ends G, H of the material 19. The upper and lower start points 20A, 20B are not necessarily set at the same distance from a center C of the material 19. Further, the angled portions at the tapered portion start points 20 are rounded in arc to prevent partial wear.

In FIG. 1, rolling marks 22, 23 or strip edge marks are formed on the surface of the work rolls 1 by the widthwise edges G, H of the material 19 being rolled. These marks are produced wherever the strip edges are located in the work rolls. If, after these marks are formed on the work rolls, the work rolls are moved in the axial direction, one of these marks 22, 23 comes inside the strip width, causing the surface defect problem.

Hence, in this embodiment, as long as a strip with a constant width continues to be rolled, the edge drop can be improved significantly by setting the tapered portion start points of the work rolls inside the strip width edges although the axial movement of the work rolls is not carried out.

It is noted, however, that even when a material with a constant width is being rolled, the amount of edge drop varies. The reason for this, as described earlier, is that the profile of the material, hardness distribution, rolling load and the amount of roll thermal expansion change even while the material being rolled has the constant width.

To deal with this problem, this embodiment adopts the following measures. Because the edge drop is mostly improved already by the tapered portions of the work rolls, this embodiment utilizes the axial movement of the intermediate rolls to minimize variations in the small remaining edge drop and make them uniform. The movement of the intermediate rolls can change the edge drop, though not as directly as do the work rolls, to sufficiently minimize the remaining edge drop.

In this embodiment therefore, the work rolls are set at appropriate axial positions so that the average value of the actual edge drop in at least one rolled coil almost agree with the target value of edge drop. The appropriate axial position setting of the work rolls that need to be estimated in advance can be determined from some operational experience.

When the average edge drop value and the target edge drop value do not agree for some reason, these positions may be corrected in the next coil. The position correction should preferably be done during the replacement of the work rolls.

In this embodiment, the axial destination positions of the intermediate rolls are controlled based on a difference between the actual edge drop value and the target edge drop value in one coil.

Figures 3A, 3B, 3C:
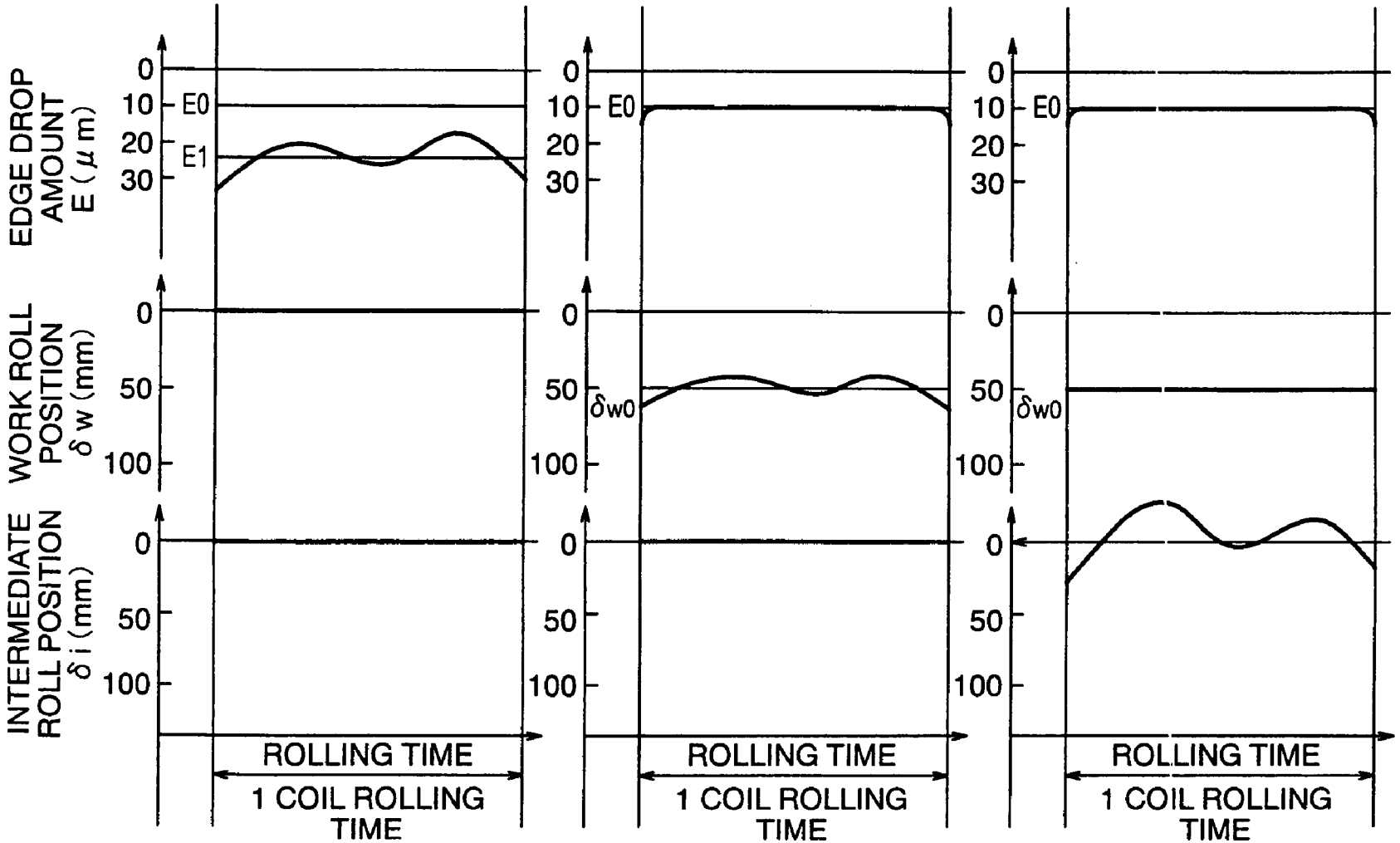
FIGS. 3A–3C are respective diagrams showing a relation between a roll position and an amount of edge drop.

FIGS. 3A–3C show an example result of edge drop control in one embodiment of the invention. Symbol E represents an amount of edge drop. In this example, the edge drop amount is a difference between the strip thickness at a position 100 mm from the strip widthwise edge and the strip thickness at a position 10 mm from the strip widthwise edge. That is, the edge drop amount indicates by how much the strip thickness 10 mm from the widthwise edge is smaller than the strip thickness 100 mm from the widthwise edge. Symbol δw in the figure denotes a work roll position, which in this case is a distance in the roll axis direction between the start point of the tapered portion of the work roll and the widthwise edge of the material on the tapered portion side. That is, the symbol δw represents the distance in the roll axis direction (strip width direction) between the position D (start point of the tapered portion of the work roll) and the position H (widthwise edge of the material on the tapered portion side) in FIG. 1 and also the distance in the roll axis direction (strip width direction) between the position G and the position F in FIG. 1.

Symbol δi in the figure denotes an intermediate roll position, which in this case is a distance in the roll axis direction between the start point of the tapered portion of the intermediate roll and the widthwise edge of the material on the tapered portion side. That is, the symbol δi represents the distance in the roll axis direction (strip width direction) between the position B (start point of the tapered portion of the intermediate roll) and the position G (widthwise edge of the material on the tapered portion side) in FIG. 1.

FIG. 3A shows a control result of a system that does not employ the axial movement of the work rolls and the intermediate rolls at all. In this case, while one coil is rolled, the edge drop amount E varies greatly in a range of between 20 μm and 30 μm with an average E1 of about 25 μm for a variety of reasons. It is seen that the average value E1 greatly differs from a target value E0 of 10 μm.

FIG. 3B shows a control result of a system that axially moves the work rolls but not the intermediate rolls. The figure shows that the axial displacement of the work rolls is very effective in correcting the edge drop and thus it is considered normally not necessary to move the intermediate rolls during one coil rolling operation to correct the edge drop. Displacing only the work roll position δw has resulted in the edge drop value E mostly agreeing with the target value E0 and its variation being kept small. This system, however, has an unresolved problem that because the work rolls are axially moved, the marks formed on the surfaces of the work rolls are transferred onto the surface of the material being rolled, causing a degraded surface quality of the product.

FIG. 3C shows a control result of a system in which the work rolls are axially moved to appropriate positions and, during the rolling operation, the work rolls are kept at these positions and the intermediate rolls are axially moved. In this system, the work rolls are set at desired positions δw0 before starting rolling one coil. The value of δw0 may be determined in advance from the value E1 obtained from the rolling operation of FIG. 3A. Alternatively, if data is available from the rolling operation of FIG. 3B, the value of δw0 can be determined in advance as an average value δw0 of the work roll position δw. This can match the average edge drop value after the rolling operation almost to the target value E0. Further, because the work roll positions are not moved during the rolling operation, no surface defect problem arises.

As to the remaining edge drop variations that cannot be suppressed by the work rolls fixed at appropriate positions, the axial positions δi of the intermediate rolls are displaced. As a result, the edge drop amount was successfully controlled to a target value.

Figure 4:
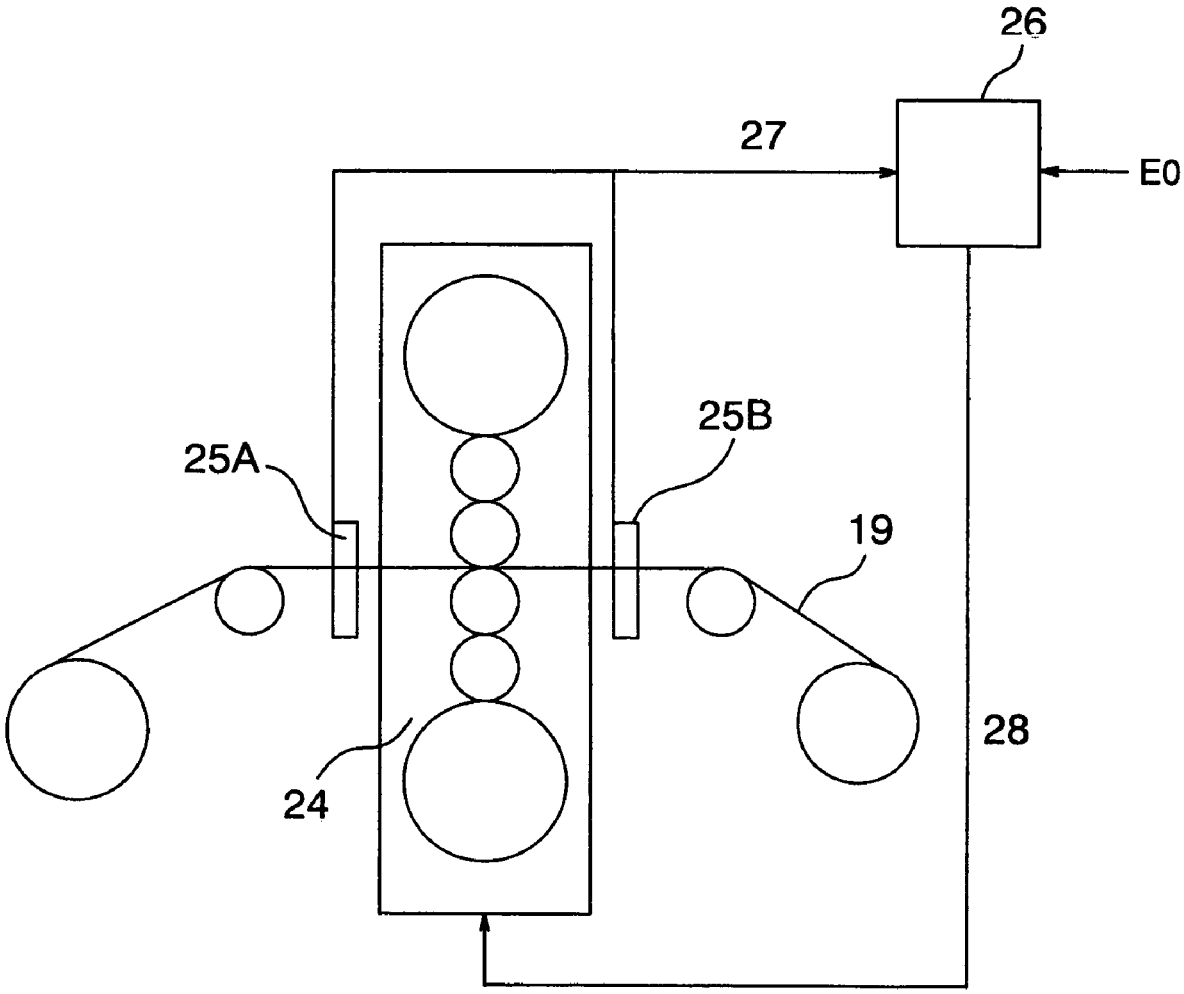
FIG. 4 is a view for showing an arrangement of components and their control, in which the invention has been incorporated.
Figure 5:
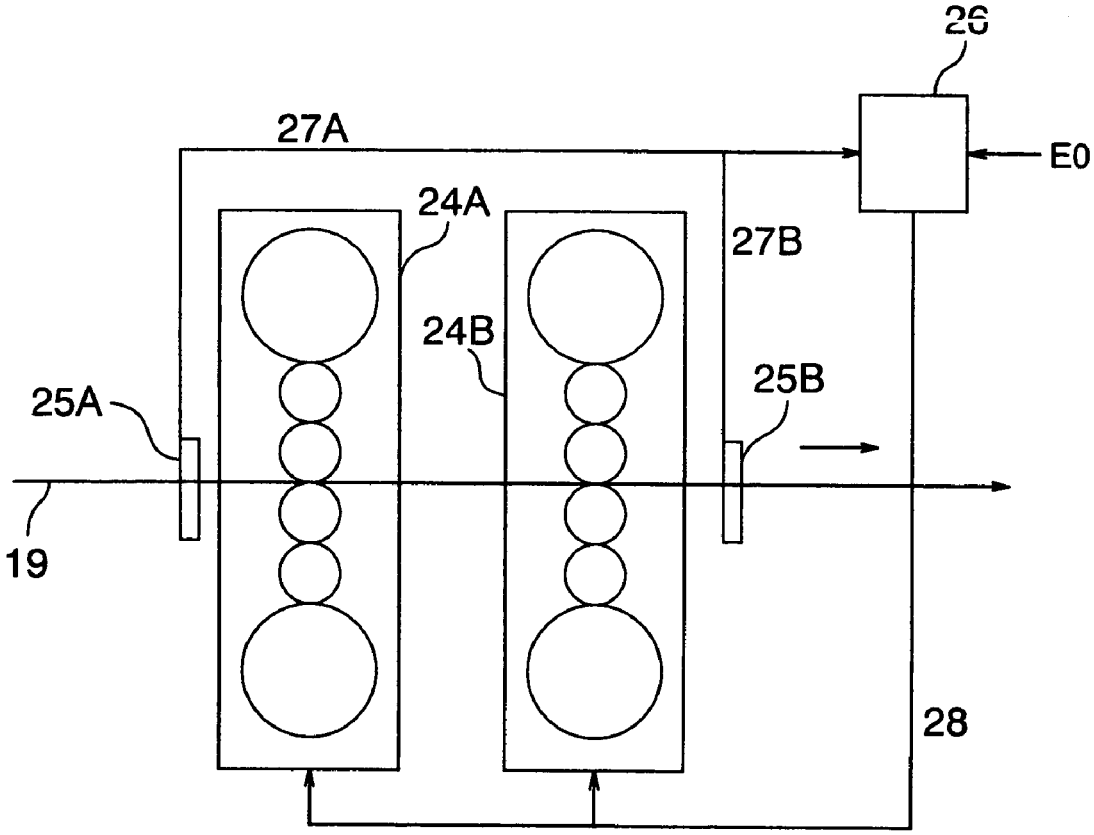
FIG. 5 is a view for showing another arrangement of components and their control, in which the invention has been incorporated.

Next, FIG. 4 and FIG. 5 show the examples of arrangements in which components and control according to the invention have been incorporated.

FIG. 4 shows an example of a one-stand reversible rolling mill, which includes a reversible 6-high rolling mill 24 according to this embodiment and means for measuring the amount of actual edge drop that occurs during the rolling operation. This rolling mill 24 is a six-high rolling mill shown in FIG. 1 and FIG. 8. In FIG. 4, detectors 25A, 25B capable of measuring edge drops are arranged before and after the rolling mill 24 to measure the edge drop of the material 19 being rolled.

The work rolls are set at desired axial positions such that their tapered portions come within the strip width when the strip with a constant width is being rolled.

The actual edge drop amount measured by the detectors 25A, 25B is sent to a control unit 26. The control unit 26 is set in advance with a target value E0 of the edge drop. Based on a difference between the target value E0 and the actual edge drop signal 27 from the detectors 25A, 25B, the control unit 26 sends an axial displacement signal 28 to an intermediate roll drive mechanism in the rolling mill 24. The drive mechanism axially moves the intermediate rolls to reduce the difference and thereby control the edge drop, while repeating the reversible rolling operation.

Based on the difference between the actual edge drop signal 27 produced by the detectors 25A, 25B and the target value E0, the control unit 26 may also send an axial displacement signal 28 to a work roll drive mechanism. This allows the work rolls to be set at more appropriate positions.

In the reversible rolling, by applying this embodiment as described above, the edge drop can be reduced without causing the surface defect problem and the edge drop variations during the rolling operation can be dealt with, thus realizing a stable rolling operation and producing a rolled product with a uniform strip thickness. Particularly because the material is reversibly rolled repetitively, the strip thickness can be controlled without causing a surface defect problem. The effect of this rolling system is significant.

FIG. 5 shows an example of a one-way rolling facility in which a rolling mill 24A and a rolling mill 24B are arranged in tandem to roll the material 19. The rolling mills 24A and 24B to which the invention has been applied and means for measuring the edge drop amount are arranged on the inlet and outlet side of these mills.

The work rolls are set at appropriate axial positions such that the tapered portions of the work rolls come within the strip width while the strip with a constant width is rolled.

The actual edge drop amount measured by the detectors 25A, 25B is sent to the control unit 26. The control unit 26 is set in advance with a target value E0 of the edge drop. Based on differences between the target value E0 and the actual edge drop signals 27A, 27B from the detectors 25A, 25B, the control unit 26 sends axial displacement signal 28 to intermediate roll drive mechanisms in the rolling mills 24A, 24B to cause the drive mechanisms to axially move the intermediate rolls to control the edge drop. Based on the differences between the actual edge drop signals 27A, 27B produced by the detectors 25A, 25B and the target value E0, the control unit 26 may also issue an axial position setting signal 28 to the work roll drive mechanisms of the rolling mill 24A and the rolling mill 25B. This allows the work rolls to be set at more appropriate positions.

In the tandem rolling, by applying this embodiment, the edge drop can be reduced without causing the surface defect problem and the edge drop variations during the rolling operation can be dealt with, thus realizing a stable rolling operation and producing a rolled product with a uniform strip thickness.

Figure 7:
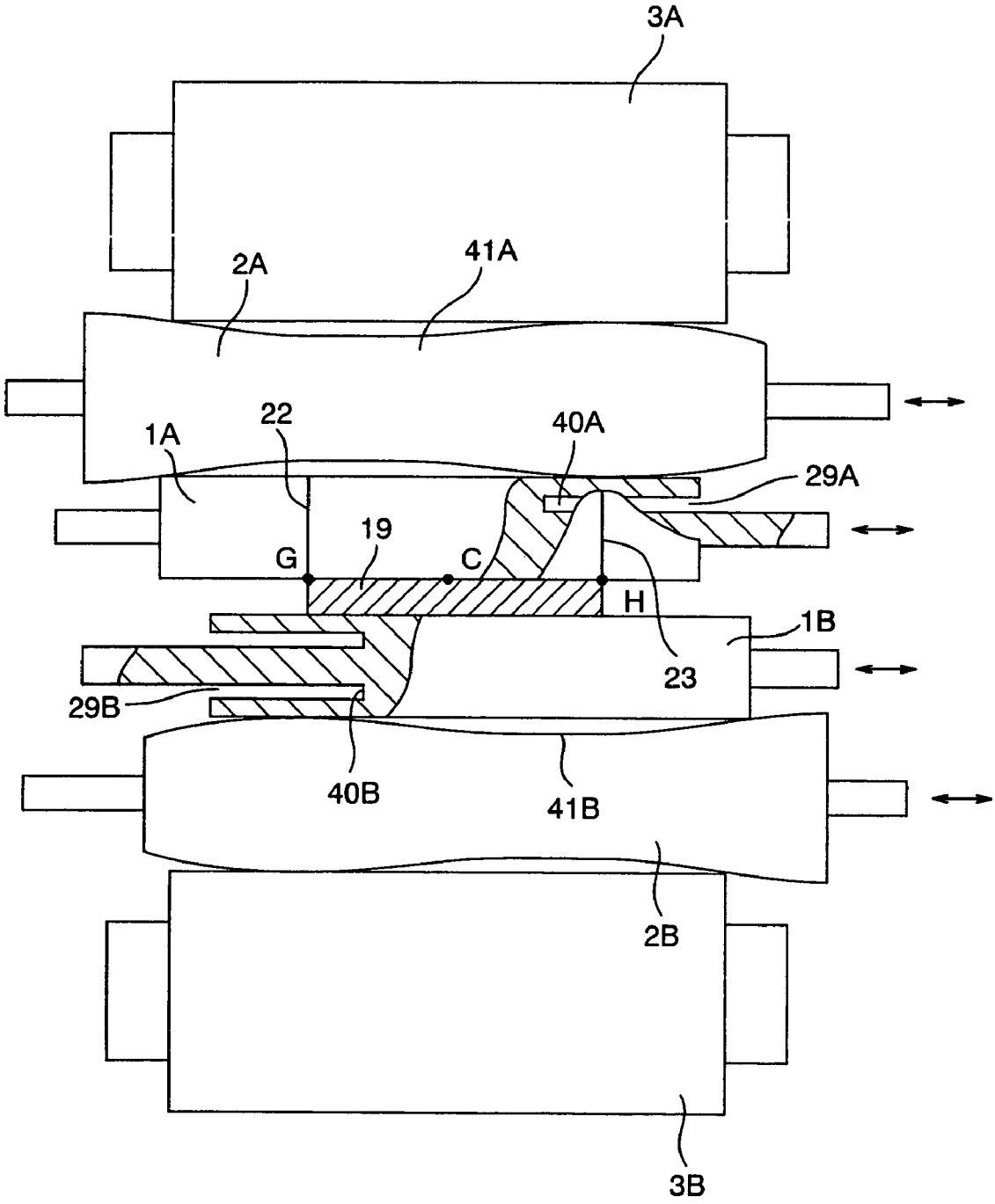
FIG. 7 is a side view of another six-high rolling mill, in which the invention has been incorporated.

FIG. 7 shows another embodiment of a six-high strip rolling mill according to the invention.

This six-high rolling mill has a pair of upper and lower work rolls 1A, 1B, a pair of upper and lower intermediate rolls 2A, 2B, and back-up rolls 3A, 3B. The work rolls 1A, 1B each have annular recesses 29A, 29B in roll body ends on one sides thereof. The intermediate rolls 2A, 2B are each provided with S-shaped roll crowns 41A, 41B. All these are arranged so as to be symmetric with respect to a point.

The work rolls 1 and the intermediate rolls 2 are axially displaceable by respective axial drive mechanisms not shown. Other constitutional components of the rolling mill are similar to those of the facility of FIG. 1 and their illustration is omitted.

In this embodiment, start points 40A, 40B of the annular recesses 29A, 29B in the work rolls are set inside the widthwise edges G, H of the material 19 to be rolled. In rolling the material 19, the upper and lower start points 40A, 40B do not have to be set at the same distance from a center C of the material 19.

Also in the construction of FIG. 7, there is a problem of the roll marks 22, 23 or strip edge marks being formed on the work rolls 1 by the edges G, H of the material 19. If, after these marks are formed, the work rolls are axially moved, one of the marks on the work rolls come within the strip width, causing the surface defect problem.

Taking advantage of the fact that the deformation rigidity of the work rolls decreases at the recessed portions of the work rolls, this embodiment puts the start points of the annular recesses inside the strip width edges to reduce and improve the edge drop.

As for the edge drop variations that are not eliminated by the annular recesses formed in the work rolls, this embodiment axially moves the intermediate rolls having the S-shaped roll crowns to minimize the edge drop variations.

While these embodiments can be applied to a one-way mill facility such as a tandem mill, more significant effects can be expected through applying these embodiments to a reversible rolling mill. These embodiments are also applicable to a hot rolling mill, but application to cold rolling, that has more stringent requirements in terms of the surface quality, can be expected to produce more remarkable effects.

As to the control system, any of the FF (feedforward), FB (feedback) and preset control may be employed. While the edge drop amount may be more advantageously determined by using a detector, the detector may not be used if the edge drop is measured in advance or predicted. There are a variety of methods for correcting the strip thickness distribution in the width direction, in addition to the one which axially moves the work rolls with tapered portions and the intermediate rolls as described above. Among other effective methods are one that axially moves rolls formed with annular recesses at one ends thereof and rolls with S-shaped roll crowns, ones that perform a roll bender force control, roll thermal crown control and roll cross angle control, and one that changes a rolling load or draft. The present invention can also be implemented by using these means, and therefore the mill facilities using these means are within an applicable scope of this invention.

For example, setting the work rolls axially movable and crosswise movable in a two-high rolling mill or setting the work rolls axially movable and the upper and lower back-up rolls crosswise movable or axially movable in a four-high rolling mill can achieve functions and effects identical to those of this invention.

Further, in Sendzimir 6-, 12- and 20-high mills, the upper and lower work rolls may be set axially movable and at the same time crosswise movable to achieve functions and effects identical to those of the present invention.

As described above, the embodiments of this invention can be applied to many types of rolling mills, such as 2-, 4-, 6-, 12- and 20-high mills, without regard to the number of stages.

With these embodiments of this invention, it is possible to reduce the edge drop of the strip being rolled, make uniform the thickness in the widthwise direction and produce a rolled product with an excellent surface property, thus contributing to improving the quality and yields of the product.

The present invention therefore can improve the edge drop significantly while minimizing the edge drop variations and perform an efficient rolling operation without causing a surface defect problem.

What is claimed is:

1. A rolling method for a rolling facility including a pair of upper and lower work rolls for rolling a strip of material, intermediate rolls for supporting each of the work rolls, back-up rolls for supporting each of the intermediate rolls, a work roll drive mechanism for moving the work rolls in directions of work roll axes, and an intermediate roll drive mechanism for moving the intermediate rolls in directions of intermediate roll axes, wherein each of the work rolls is provided with a tapered portion near one end thereof and the tapered portions of the work rolls are arranged on opposite sides of roll bodies thereof with respect to the work roll axis directions, comprising the steps of:

performing reversible rolling by reversing a rolling direction of the strip of material;

during all rolling passes in the reversible rolling, fixing axial positions of the work rolls at desired positions so that the work rolls are not axially moved and points at which the tapered portions of the work rolls start come within a width of the strip of material; and performing the rolling while changing axial positions of the intermediate rolls to control a thickness distribution in a width direction of the strip of material.

2. A rolling method for a rolling facility including a pair of upper and lower work rolls for rolling a strip of material, intermediate rolls for supporting each of the work rolls, back-up rolls for supporting each of the intermediate rolls, a work roll drive mechanism for moving the work rolls in directions of work roll axes, and an intermediate roll drive mechanism for moving the intermediate rolls in directions of intermediate roll axes, wherein each of the work rolls is provided with a tapered portion near one end thereof and the tapered portions of the work rolls are arranged on opposite sides of roll bodies thereof with respect to the work roll axis directions, comprising the steps of:

performing reversible rolling by reversing a rolling direction of the strip of material;

during all rolling passes in the reversible rolling, fixing axial positions of the work rolls at desired positions so that the work rolls are not axially moved and surface defects are prevented from being caused in the strip of material by strip edge marks in surfaces of the work rolls; and performing the rolling while positioning points at which the tapered portions of the work rolls start within a width of the strip of material and while changing axial positions of the intermediate rolls to control a thickness distribution in a width direction of the strip of material so that an edge drop of the strip of material is improved.

* * * * *